US005704318A

United States Patent [19]

Mori

[11] Patent Number: 5,704,318

[45] Date of Patent: Jan. 6, 1998

[54] METHOD OF ADJUSTING A VALVE CLEARANCE

[75] Inventor: Akiyoshi Mori, Yokohama, Japan

[73] Assignee: Fuji Oozx, Inc., Japan

[21] Appl. No.: 779,568

[22] Filed: Jan. 9, 1997

Related U.S. Application Data

[62] Division of Ser. No. 597,885, Feb. 7, 1996, Pat. No. 5,640,934.

[30] Foreign Application Priority Data

Feb. 20, 1995 [JP] Japan ..... 7-30700

[51] Int. Cl.[6] ..... F01L 1/20

[52] U.S. Cl. ..... 123/90.52; 123/90.45

[58] Field of Search ..... 123/90.39, 90.45, 123/90.46, 90.48, 90.49, 90.52, 90.55

[56] References Cited

U.S. PATENT DOCUMENTS

| | | | |
|---|---|---|---|
| 2,954,016 | 9/1960 | Leese | 123/90.52 |
| 3,989,016 | 11/1976 | Morgan | 123/90.16 |
| 5,119,774 | 6/1992 | Krieg et al. | 123/90.55 |
| 5,295,460 | 3/1994 | Dohring et al. | 123/90.55 |

FOREIGN PATENT DOCUMENTS

| | | |
|---|---|---|
| 2083890 | 12/1971 | France . |
| 2584138 | 1/1987 | France . |
| 30 17 990 | 11/1981 | Germany . |

*Primary Examiner*—Weilun Lo

*Attorney, Agent, or Firm*—Graham & James LLP

[57] ABSTRACT

Between the end of a valve and a valve-operating cam in an internal combustion engine, a valve lifter is inserted. A filler enclosing portion is formed between a shim and the body of the valve lifter. Through an opening from an injector, a filler is introduced into the filler enclosing portion, so that valve clearance is corrected to zero. Differences in valve clearance can be easily corrected.

6 Claims, 5 Drawing Sheets

METHOD OF ADJUSTING A VALVE CLEARANCE

This is a division of application Ser. No. 08/597,885, filed on Feb. 7, 1996, now U.S. Pat. No. 5,640,934.

BACKGROUND OF THE INVENTION

This invention relates to a method of adjusting valve clearance, and especially to a method of adjusting a valve clearance, a valve lifter used therein and an intermediate of the valve lifter in a valve operating mechanism of an internal combustion engine.

As known means for adjusting a valve clearance in a valve operating mechanism in an internal combustion engine, there are a method of forming a shim engaging portion at the top of a valve lifter between a valve and a cam and engaging a shim having a suitable thickness corresponding to size in an internal combustion engine, and a method by an auto-lash adjuster for automatically adjusting a valve clearance at any time to keep it in zero by hydraulic pressure.

However, in the method of employing a shim, it is required to use a plurality of shims having slightly different thickness, so that it is troublesome to manufacture and control it, and the method by the auto-lash adjuster involves expensive complicated structure.

SUMMARY OF THE INVENTION

In view of the disadvantages, it is an object of the present invention to provide a method of adjusting a valve clearance, a valve lifter used therein and an intermediate of the valve lifter, the method being capable of adjusting variations in the valve clearance caused by errors in size of each internal combustion engine when or before the valve lifter is mounted without a number of shims or an auto-lash adjuster having complicated structure.

To solve the disadvantages, according to one aspect of the present invention, there is provided a method of adjusting a valve clearance in a valve operating mechanism, the method comprising the steps of:

connecting a first member having a valve contacting surface which contacts an end of a valve, with a second member which has a cam contacting surface which contacts a cam for operating the valve, to provide a volume-variable filler enclosing portion between the first and second members to form an intermediate of a valve lifter;

attaching the intermediate between the cam and the end of the valve; and introducing a filler into the filler enclosing portion to define a distance between the first and second members to a suitable one to finish the valve lifter.

By using the method, when the valve lifter is mounted in the valve operating mechanism, to correct errors in each valve operating mechanism, valve clearance can be always nil without a number of different thickness shims or expensive auto-lash adjuster.

According to another aspect of the present invention, there is provided a method of adjusting a valve clearance in a valve operating mechanism, the method comprising the steps of:

connecting a first member having a valve contacting surface which contacts an end of a valve, with a second member which has a cam contacting surface which contacts a cam for operating the valve, to provide a volume-variable filler enclosing portion between the first and second members to form an intermediate of a valve lifter;

putting the intermediate between a pair of holding parts of a jig, a distance between the pair of the holding parts being defined to a suitable one predetermined depending on a size in the valve operating mechanism in which the valve lifter is to be mounted;

introducing a filler into said filler enclosing portion to move the first and second members until the valve contacting surface and the cam contacting surface contact the holding parts respectively to finish the valve lifter; and attaching the valve lifter between the cam and the end of the valve in the valve operating mechanism.

The valve lifter can be manufactured before the valve lifter is assembled in the valve operating mechanism. After assembling, valve clearance may be zero or predetermined value, which is convenient in mass production.

According to further aspect of the present invention, there is provided an intermediate of a valve lifter, comprising:

a first member which has a valve contacting surface which contacts an end of a valve;

a second member which has a cam contacting surface which slidably contacts a cam for operating a valve; and a volume-variable filler enclosing portion between the first and second members.

By one intermediate, a number of valve lifters in which distance between the valve contacting surface and cam contacting surface is different can be easily manufactured.

According to additional aspect of the present invention, there is provided a valve lifter which comprises:

a first member which has a valve contacting surface which contacts an end of a valve;

a second member which has a cam contacting surface which slidably contacts a cam for operating a valve; and a volume-variable filler enclosing portion between the first and second members, a predetermined amount of filler being contained in said filler enclosing portion.

BRIEF DESCRIPTION OF THE DRAWINGS

The features and advantages of the present invention will become more apparent from the following description of preferred embodiments with respect to appended drawings wherein.

DETAILED DESCRIPTION OF PREFERRED EMBODIMENTS

Figure 1:
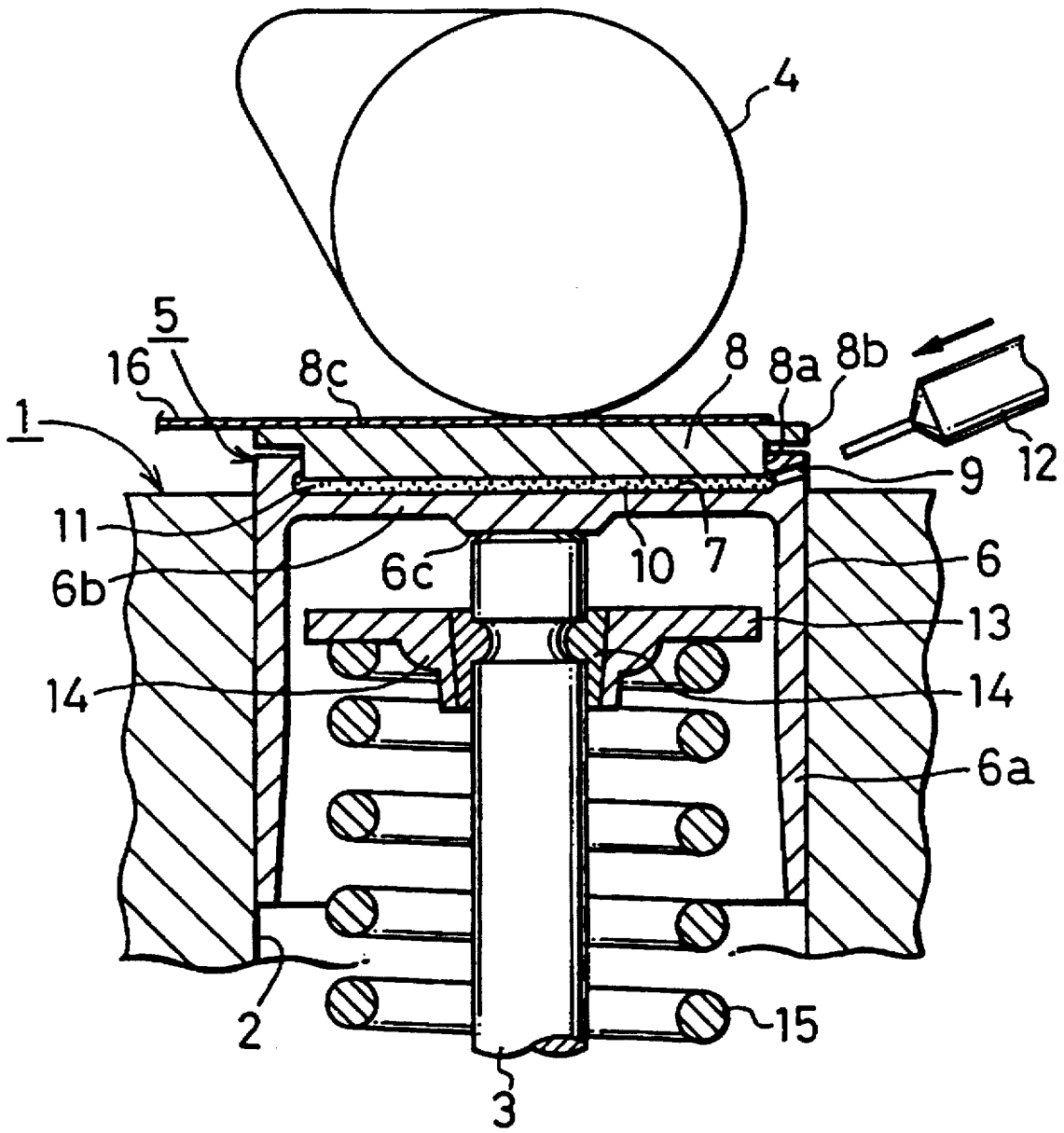
FIG. 1 is a vertical sectional front view of a valve operating mechanism in an internal combustion engine to illustrate a method of adjusting a valve clearance according to the present invention.

FIG. 1 illustrates one embodiment of a method according to the present invention, and the first embodiment of a valve lifter used in the method and an intermediate thereof.

The numeral 1 denotes a cylinder head in an internal combustion engine; 2 denotes a guide bore; 3 denotes a popper valve; and 4 denotes a cam for operating the valve. A cylindrical valve lifter 5 is slidably engaged between the end of the valve 3 and the cam 4 in the guide bore 2 of the cylinder head 1. The valve lifter 5 and an intermediate thereof comprises a body 6 (first member) which comprises a circumferential wall 6*a* and a roughly horizontal wall 6*b* which closes at a little lower position than the upper end of the circumferential wall 6*a*, and an engagement member 8 (second member) which is engaged in a circular recess 7 which is formed by the horizontal wall 6*b* and the upper end of the circumferential wall 6*a*. In the circumferential wall 6*a* of the body 6, there is provided an opening 9 through which the bottom of the recess 7 communicates with the outside of the valve lifter 5. A valve-contacting surface 6*c* which contacts the end of the valve 3 is formed in the middle of the lower surface of the horizontal wall 6*b* of the body 6. The engagement member 8 comprises a smaller-diameter portion 8*a* which is inserted in the recess 7 and a larger-diameter portion 8*b* which has roughly the same outer diameter as that of the body 6, the upper surface of the larger-diameter portion 8*a* being a cam-contacting surface 8*c*.

The body 6 and the engagement member 8 may be made of Fe alloy or Al light alloy. Especially, when the body 6 is made of Al light alloy, the engagement member 8 may be made of more wear-resistant metal than what is used in the body, or more wear-resistant Fe-metal or other material. 10 denotes a filler in a volume-variable filler enclosing portion 11 which is formed between the recess 7 and the lower end of the engagement member 8. The filler 10 may have fluidity when it is introduced into the filler enclosing portion 11 via the opening 9 and is readily curable after introduction. Especially, the filler includes a known two-liquid-mixing type reaction curable synthetic resin, thermosetting resin, optically curable synthetic resin, powdery material such as gypsum and other ceramics, mixing material of the powdery material and hardening agent, and wax.

When thermosetting resin is used as filler, the valve lifter 5 is heated to setting temperature. When optically curable synthetic resin is used, the end of a floodlight (not shown) which has optical fibers is inserted into the opening 9 after introduction and the filler enclosing portion 10 is lighted. In this case, a plurality of openings 9 are radially provided on the circumferential wall 6*a*, from which it is lighted.

The numeral 13 denotes a spring retainer which is fitted around the end of the valve 3 via a cotter 14, and 15 denotes a coiled spring for forcing the valve at any time in a valve-closing direction, i.e. in an upper direction in FIG. 1 via the spring retainer 13 and the cotters 14. 16 denotes a spacer which is used, if necessary, when the valve lifter 5 is combined in the valve operating mechanism, and its thickness is set to be equal to the suitable valve clearance in the valve operating mechanism.

Then, one embodiment of a method of adjusting a valve clearance according to the present invention will be described with a way for mounting the valve operating mechanism in the internal combustion engine. An intermediate of a valve lifter 5 comprises the recess 7 of the body 6 in which the engagement member 8 is slidably engaged in an axial direction. The intermediate is slidably engaged in the guide bore 2 of the cylinder head 1 between the end of the valve 3 and the cam 4 for moving the valve 3. The cam 4 is placed such that its base faces downward.

Then, if necessary, a spacer 16 which has thickness corresponding to suitable valve clearance is inserted between the cam 4 and a cam contacting surface 8*c* of the engagement member 8, and in that situation, a filler injector 12 is inserted into the opening 9, and the above filler 10 is injected into the filler enclosing portion 11 formed between the body 6 and the engagement member 8. Thus, internal pressure of the filler 10 expands the engagement member 8 and the body 6 in a vertical direction, so that the cam contacting surface 8*c* of the engagement member 8 contacts the cam 4 (without the spacer 16) or the lower surface of the spacer 16 and the valve contacting surface 6*c* contacts the end of the valve 3 respectively, thereby making valve clearance zero (without the spacer 16) or suitable value (with the spacer 16).

When the filler 10 in the filler enclosing portion 11 is cured, the body 6, the engagement member 8 and the filler 10 become one rigid body to form a valve lifter 5. When the spacer 16 is used, it is taken out of between the cam 4 and the cam contacting surface 8*c* of the engagement member 8. Thus, the valve clearance is kept the same distance as the thickness of the spacer 16.

Figure 2:
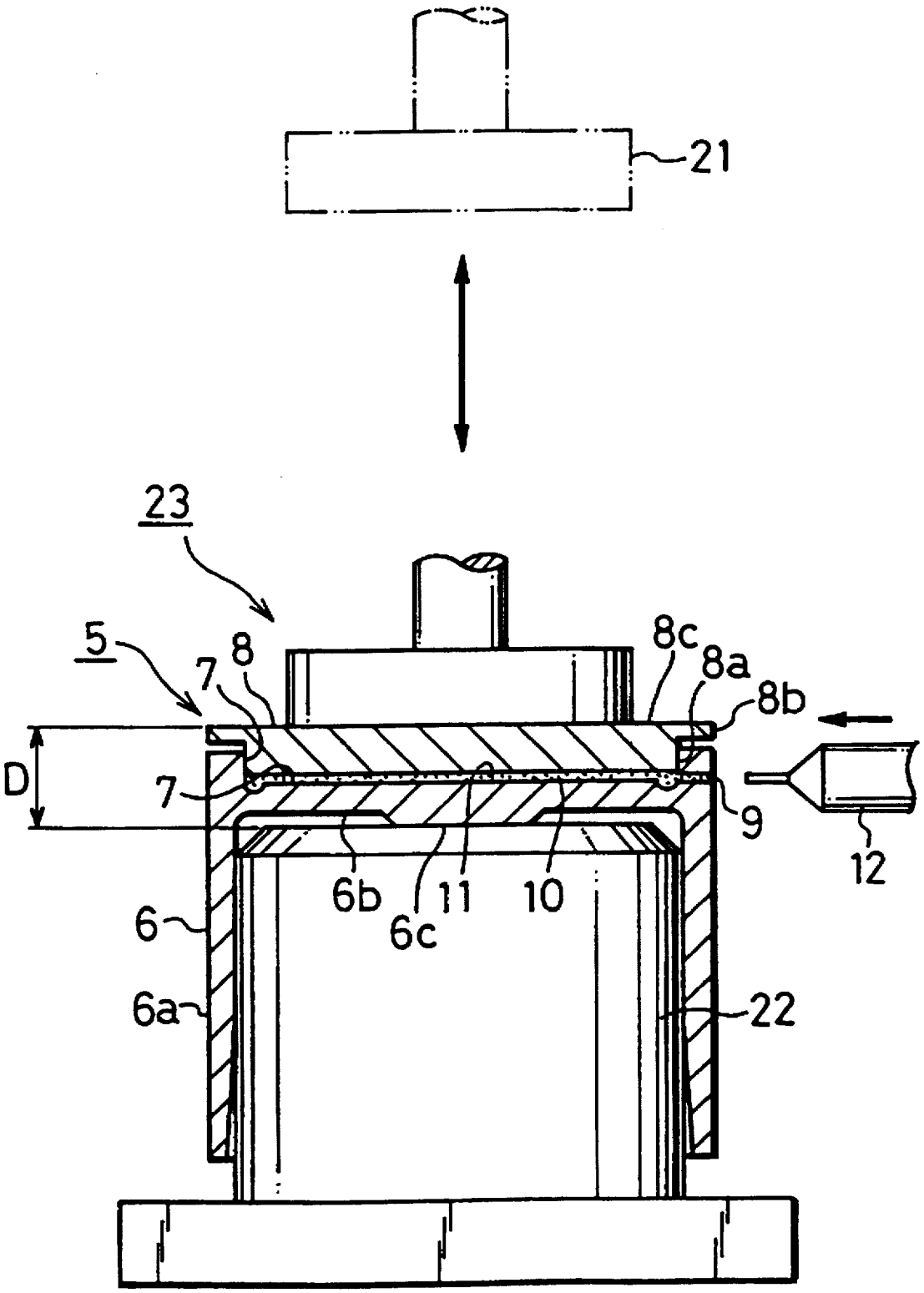
FIG. 2 is a vertical sectional front view of an intermediate of a valve lifter and jigs therefor to illustrate another method of adjusting valve clearance according to the present invention.

FIG. 2 illustrates another embodiment of a method of adjusting a valve clearance according to the present invention, in which a valve lifter and an intermediate thereof in use for the method are the same as those in FIG. 1, and are shown by the same numerals, detailed description of which is omitted. Members of a valve operating mechanism not shown in FIG. 2 are described by numerals shown in FIG. 1.

In the method, as shown by a solid line in FIG. 2, there is provided a jig 23 which can be opened and closed vertically to adjust a distance between upper and lower holding parts 21 and 22 when closed exactly to a suitable predetermined distance on the basis of a size of a valve operating mechanism to which a valve lifter is mounted. As shown by two dotted lines in FIG. 2, the upper holding part 21 is placed, and an intermediate of a valve lifter 5 is slidably engaged with a recess 7 of a body 6 on the lower holding part 22. Then, the upper holding part 21 is lowered to a predetermined position as shown by a solid line in FIG. 2; thereafter, a filler injector 12 is inserted into an opening 9; and a filler 10 similar to the above is injected into a filler enclosing portion 11 formed between the body 6 and an engagement member 8. Thus, the engagement member 8 and the body 6 are expanded similar to the above, thereby bringing the cam contacting surface of the engagement member 8 into contact with the lower surface of the holding part 21, and the valve contacting surface 6*c* of the body 6 into contact with the upper end of the holding part 22, so that the distance between the cam contacting surface 8*c* and the valve contacting surface 6*a* becomes a suitable value for valve operating mechanism in which the valve lifter is attached.

Thereafter, when the filler 10 in the filler enclosing portion 11 is cured, the body 6, the engagement member 8 and the filler 10 become one rigid body to form a valve lifter.

After the valve lifter 5 is finished, the holding part 21 goes up and the valve lifter 5 is taken up out of the jigs 23. The valve lifter 5 is placed between the end of the valve 3 and the cam 4, and is slidably engaged in the guide bore 2, so that valve clearance is maintained as suitable value.

FIGS. 3 to 8 illustrate variations of a valve lifter and intermediates thereof in use for a method of the present invention.

Figure 3:
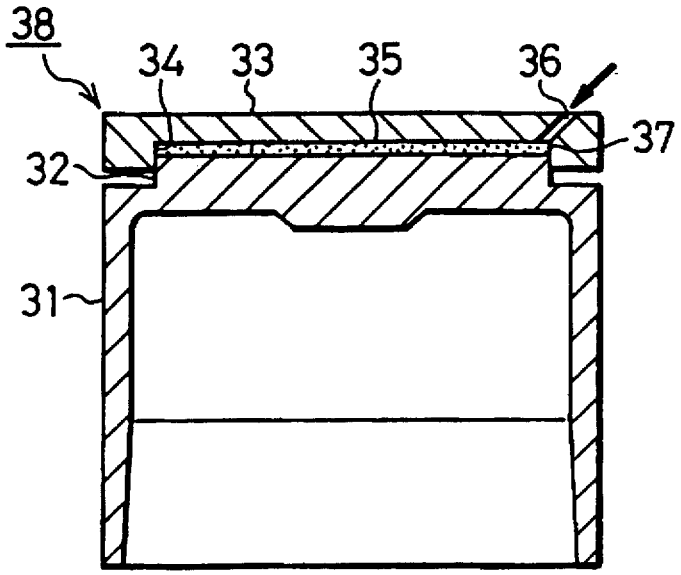
FIG. 3 is a vertical sectional front view of a variation of a valve lifter and an intermediate thereof in use for the method according to the present invention.

In FIG. 3, a smaller diameter portion 32 is formed in the middle of the upper surface of a body 31 which is the first member 31, and on the portion 32, a recess 34 of the engagement member 33 which is the second member is slidably engaged. A filler 35 similar to the filler 10 as above is filled into a filler enclosing portion 37 between the lower surface of the recess 34 and the upper end of the smaller diameter portion 32 via an opening 26 of the engagement member 33 to finish a valve lifter 38.

Figure 4:
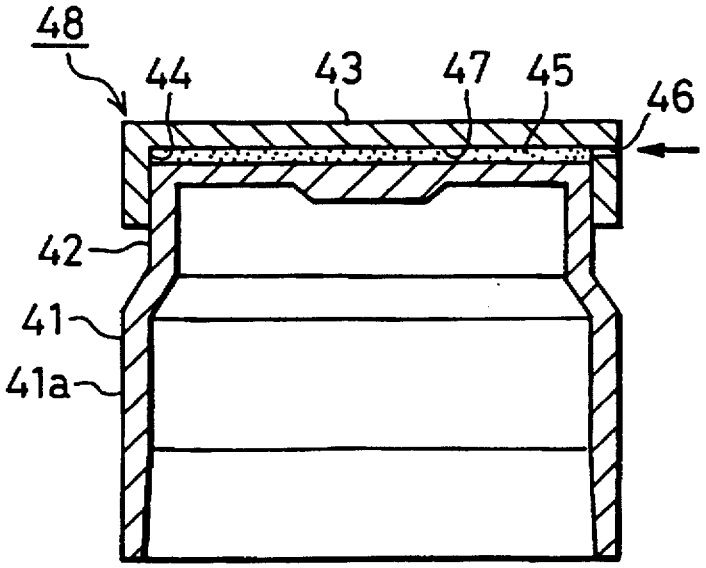
FIG. 4 is a vertical sectional front view of another variation of a valve lifter and an intermediate thereof in use for the method according to the present invention.

In FIG. 4, there is formed a smaller diameter portion 42 around the upper end of a circumferential wall 41*a* of a body 41 which is the first member. The smaller-diameter portion 42 is slidably engaged in a recess 44 of an engagement member 43 which is the second member. A filler enclosing portion 47 between the recess 44 and the upper end of the body 41 is filled with a filler 45 similar to the above filler 10 through an opening 46 of the engagement member 43 to finish a valve lifter 48, thereby simplifying the structure compared with that in FIG. 3.

Figure 5:
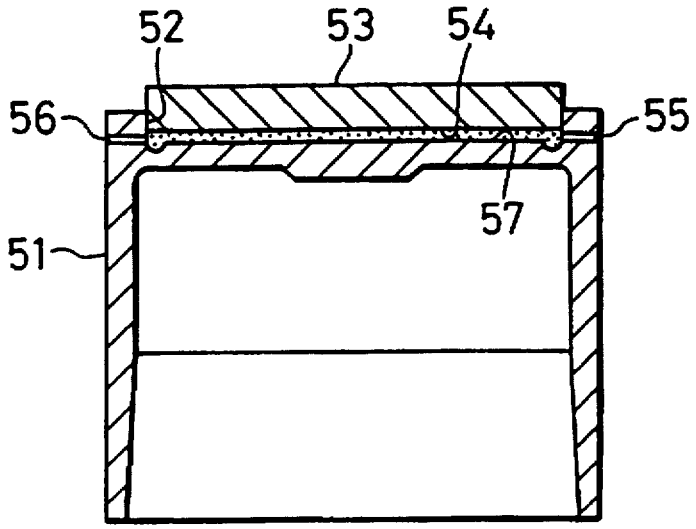
FIG. 5 is a vertical sectional front view of a further variation of a valve lifter and an intermediate thereof in use for the method according to the present invention.

In FIG. 5, on the upper surface of a body 51 which is the first member, a circular recess 52 is formed, in which an engagement member 53, such as a known shim, which is the second member is slidably engaged. Through one of a pair of openings 55 and 56 opposite to each other on the body 51, a filler enclosing portion 57 between the recess 52 and the lower end of the engagement member 53 is filled with a filler 54 similar to the above filler 10, and the filler 54 is slightly pressed out through the other of the openings 55 and 56, thereby preventing air collection in the filler enclosing portion 57, to finish a valve lifter 58.

Figure 6:
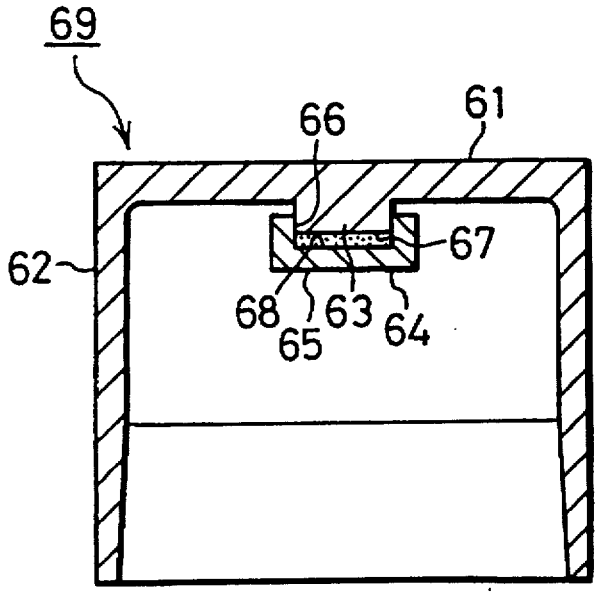
FIG. 6 is a vertical sectional front view of yet another variation of a valve lifter and an intermediate thereof in use for the method according to the present invention.

In FIG. 6, a cylindrical projection 63 is formed at the center of the lower surface of a body 62 which has a cam contacting upper surface 61, and is slidably engaged in a recess 66 of an engagement member 65, and a filler enclosing portion 67 between the recess 66 and the lower end of the cylindrical projection 63 is filled with a filler 68 to finish a valve lifter 69. In this embodiment, the engagement member 65 having the valve contacting surface 64 is the first member, and the body 62 having the cam contacting surface 61 is the second member.

Figure 7:
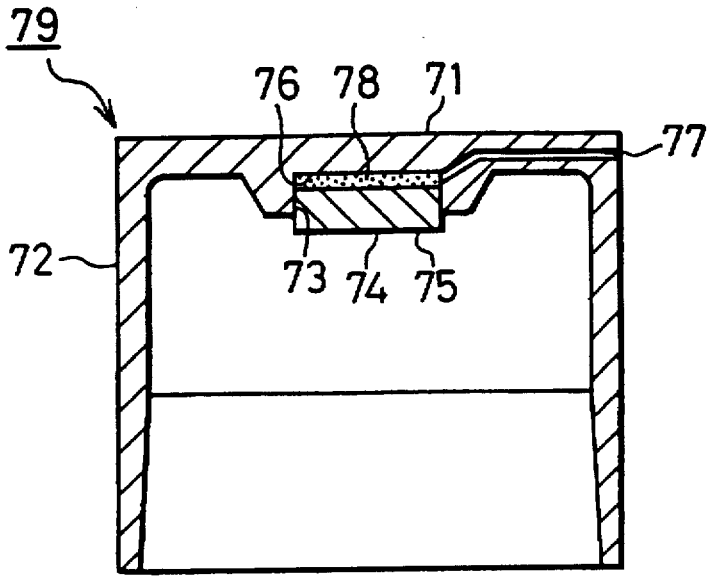
FIG. 7 is a vertical sectional front view of a still further variation of a valve lifter and an intermediate thereof in use for the method according to the present invention.

In FIG. 7, a circular recess 73 is formed on the lower surface of a body 72 which has a cam contacting upper surface 71. A disc-like engagement member 57 having a valve contacting lower surface 74 and similar to a known shim is slidably engaged in the recess 73. A filler enclosing portion 76 between the recess 73 and the upper surface of the engagement member 75 is filled with a filler 78 through an opening 77 of the body 72, to finish a valve lifter. In this embodiment, the engagement member 75 having the valve contacting surface 74 is the first member, and the body 72 having the cam contacting surface 71 is the second member.

Figure 8:
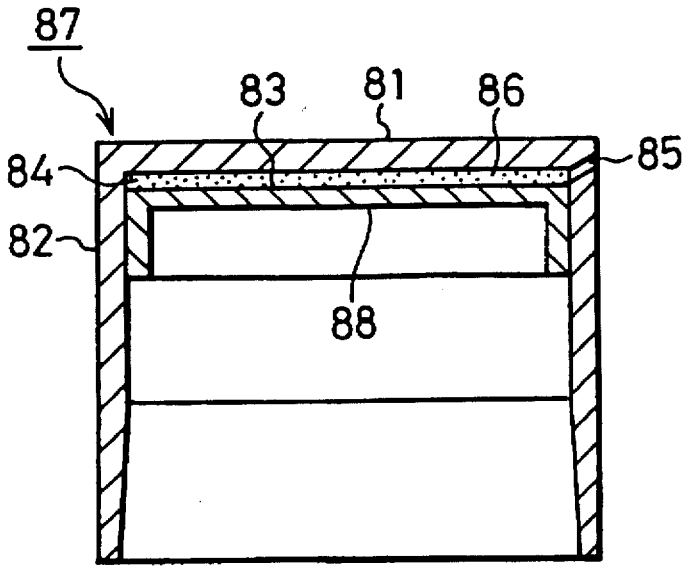
FIG. 8 is a vertical sectional front view of additional variation of a valve lifter and an intermediate thereof in use for the method according to the present invention.

In FIG. 8, a cylindrical engagement member 83 is slidably engaged in a body 82 having a cam contacting upper surface 91. A filler enclosing portion 84 between the body 82 and the upper surface of the engagement member 83 is filled with a filler 86 through an opening 85 of the body 82 to finish a valve lifter 87. In this embodiment, the engagement member 83 having the valve contacting lower surface 88 is the first member, and the body 82 having the cam contacting surface 81 is the second member. The valve lifter of the present invention simplifies the structure of the body 82 and the engagement member 83 and may be easily manufactured.

Other variations may be possible according to the present invention. For example, in FIG. 1, after the filler 10 is injected through the opening 9, a stopper (not shown) may be inserted in the opening 9 to close it, or wear resistant different metal may be overlapped on the upper surface of the engagement member 8.

The foregoings merely relate to embodiments of the present invention. Various changes and modifications may be made by person skilled in the art without departing from the scope of claims wherein:

What is claimed is:

1. A method of adjusting a valve clearance in a valve operating mechanism, the method comprising the steps of:

connecting a first member having a valve contacting surface which contacts an end of a valve, with a second member which has a cam contacting surface which contacts a cam for operating the valve, to provide a volume-variable filler enclosing portion between the first and second members to form an intermediate space of a valve lifter;

providing the intermediate space between the cam and the end of the valve; and introducing a curable filler into the filler enclosing portion to define a distance between the first and second members to a suitable one to finish the valve lifter.

2. A method as defined in claim 1 wherein the first member is a body of the valve lifter and the second member is an engagement member.

3. A method as defined in claim 1 wherein the first member is an engagement member and the second member is a body of the valve lifter.

4. A method as defined in claim 2 or 3 wherein the engagement member comprises a shim.

5. A method as defined in claim 2 wherein the filler is introduced from a filler injector through an opening provided in a circumferential wall of the body of the valve lifter.

6. A method as defined in claim 1, comprising the step of:

inserting a spacer which has a thickness equal to a suitable valve clearance, between the cam and the cam contacting surface of the second member before the filler is introduced into the filler enclosing portion.

* * * * *